US010610020B2

(12) United States Patent
Garrison et al.

(10) Patent No.: US 10,610,020 B2
(45) Date of Patent: Apr. 7, 2020

(54) CHAIR WITH SLOTTED HINGE FOLDING MECHANISM

(71) Applicant: Rio Brands, LLC, W. Conshohocken, PA (US)

(72) Inventors: Scott Garrison, Fitchburg, WI (US); Kalman Fang, Taizhou (CN)

(73) Assignee: Rio Brands, LLC, Watertown, CT (US)

( * ) Notice: Subject to any disclaimer, the term of this patent is extended or adjusted under 35 U.S.C. 154(b) by 0 days.

(21) Appl. No.: 15/968,737

(22) Filed: May 1, 2018

(65) Prior Publication Data

US 2019/0335904 A1 Nov. 7, 2019

(51) Int. Cl.
*A47C 4/42* (2006.01)

(52) U.S. Cl.
CPC ..... *A47C 4/42* (2013.01)

(58) Field of Classification Search
CPC ..... A47C 4/28; A47C 4/42
See application file for complete search history.

(56) References Cited

U.S. PATENT DOCUMENTS

| | | | | | |
|---|---|---|---|---|---|
| 125,556 | A | | 4/1872 | Everickx | |
| 148,230 | A | * | 3/1874 | McAleer | A47C 4/14 297/31 |
| 1,919,820 | A | * | 7/1933 | Ashleman | A47C 4/12 297/16.2 |
| 2,638,970 | A | * | 5/1953 | Harber | A47C 4/48 297/27 |
| 4,613,185 | A | | 9/1986 | Marchesini | |
| 4,693,510 | A | | 9/1987 | Marchesini | |
| 4,707,023 | A | * | 11/1987 | Hickey | A47C 7/405 297/31 |
| 5,139,208 | A | * | 8/1992 | Schooley | B65H 75/06 211/194 |
| 5,577,799 | A | | 11/1996 | St. Germain | |
| 5,964,500 | A | * | 10/1999 | Lin | A47C 4/20 297/16.1 |
| 6,698,828 | B1 | | 3/2004 | Chan | |
| 9,737,147 | B2 | | 8/2017 | Shadley | |
| 2008/0284216 | A1 | | 11/2008 | Mayercheck | |

* cited by examiner

*Primary Examiner* — Philip F Gabler
(74) *Attorney, Agent, or Firm* — Carmody Torrance Sandak & Hennessey LLP

(57) ABSTRACT

A folding chair assembly with an improved folding mechanism. The folding chair assembly has a backrest structure, a seat structure, and an armrest structure that are all made from shaped tube forms. The tube form of the armrest structure is attached to the tube form of the backrest structure with a pivot connection. The tube form of the armrest structure is also attached to the tube form of the seat structure at a pivot connection. A slotted linkage is provided that extends between the tube form of the backrest and the tube form of the seat. The slotted linkage is pivotably connected to either the backrest structure or to the seat structure. The slotted linkage defines a slot. The slot engages a fixed pin on either the seat structure or the backrest structure. The fixed pin reciprocally moves within the slot as the folding chair assembly is manipulated.

9 Claims, 5 Drawing Sheets

CHAIR WITH SLOTTED HINGE FOLDING MECHANISM

BACKGROUND OF THE INVENTION

1. Field of the Invention

In general, the present invention relates to the structure of armrests that are used on folding chairs, collapsible chairs, camp chairs, beach chairs and other portable lightweight chairs. More particularly, the present invention relates to the folding mechanism on the chair that enables the backrest of the chair to fold flat against the seat of the chair as the chair is folded closed.

2. Prior Art Description

Many chairs are designed to be foldable or collapsible so that they can be easily transported. In addition to be being foldable or collapsible, such chairs are made to be as lightweight as possible while still being functionally sound. In this manner, the chair is not burdensome to carry. Such chairs are often brought to the beach, to tailgate parties, to concerts and to other such locations that require a chair to be carried a significant distance.

In order to make a chair lightweight, a folding chair is typically manufactured with minimal components. Often the chair is little more than fabric stretched over some lightweight bent tubing to form a backrest and a seat. When the chair is folded, the seat is folded against the backrest so that the backrest and seat are close to parallel. The simplest way to make the seat of a folding chair fold against the backrest of a folding chair is to join the seat to the backrest at a simple hinged joint. One disadvantage of a hinge joint is that the joint causes the seat to engage the backrest at a slight angle. Accordingly, the seat and the backrest are not quite parallel when the folding chair is folded closed. The folding chair is, therefore, not as compact as it could be. Furthermore, if the chair is compressed flat while being packed or stored, the hinge can break or bend, therein damaging the chair.

To prevent the disadvantages presented by a simple hinged joint, many folding chairs use linkage hinges, where both the backrest and the seat are connected to intermediary linkages rather than to each other. Such linkage hinges are exemplified in U.S. Pat. No. 9,737,147 to Shadley and U.S. Pat. No. 6,698,828 to Chan. In order for a linkage hinge to work properly, certain compromises must be made in the design. The linkage used in prior art linkage hinges have fixed lengths. This fixed length is calculated to enable the seat to open and close. However, as is often is the case, the fixed length of the linkage prevents the chair from opening to a wide angle. As such, the linkage hinge is typically designed to be compromise that enables a folding chair to open and close, but to degrees less than would otherwise be desirable.

A need therefore exists for a folding chair with an improved linkage hinge that enables the chair to be both fully opened at a desired angle and fully closed without compromise. This need is met by the present invention as described and claimed below.

SUMMARY OF THE INVENTION

The present invention is a folding chair assembly with an improved folding mechanism. The folding chair assembly has a backrest structure, a seat structure, and an armrest structure that are all made from shaped tube forms. The tube form of the armrest structure is attached to the tube form of the backrest structure with a first pivot connection. The tube form of the armrest structure is also attached to the tube form of the seat structure at a second pivot connection.

A slotted linkage is provided that extends between the tube form of the backrest and the tube form of the seat. The slotted linkage is pivotably connected to either the backrest structure or to the seat structure. The slotted linkage defines a slot. The slot engages a fixed pin on either the seat structure or the backrest structure. The fixed pin reciprocally moves within the slot as said folding chair assembly is manipulated between a folded configuration and an open configuration. The complex movements enabled by the slotted linkage allow the backrest structure to fold flush against the seat structure, therein minimizing the bulk of the folding chair when in its folded configuration.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Many different models of folding chairs have backrests and seats that fold against each other using a linkage hinge. The present invention can be adapted to most such folding chair designs. However, for the purposes of description and explanation, only one exemplary embodiment of a folding chair is being illustrated. The exemplary embodiment is selected in order to set forth one of the best modes contemplated for the invention. The illustrated embodiment, however, is merely exemplary and should not be considered a limitation when interpreting the scope of the appended claims.

Figure 1:
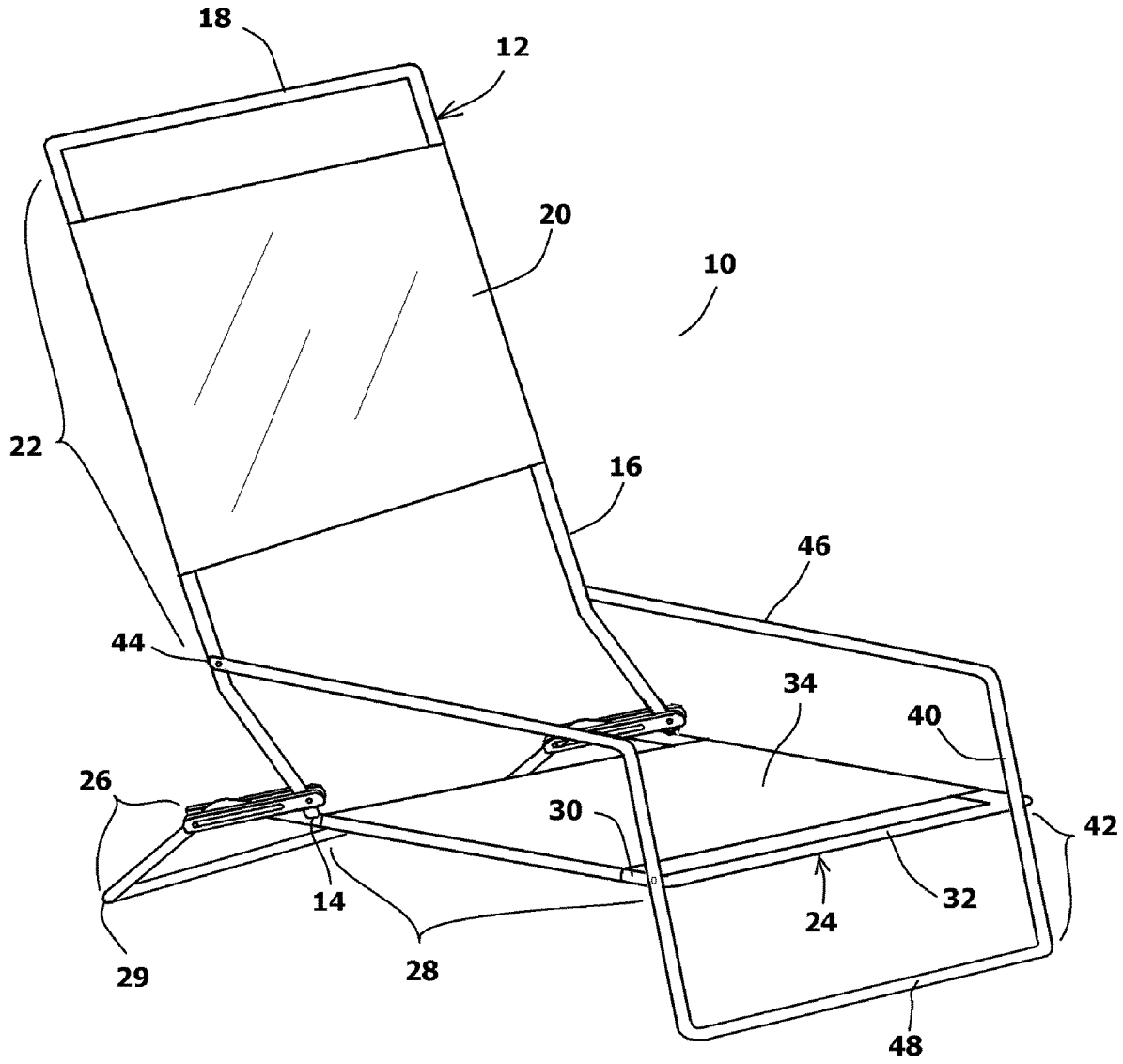
FIG. 1 is perspective view of an exemplary embodiment of a folding chair.

Referring to FIG. 1, a folding chair 10 is presented that is primarily formed from three tube forms. Each tube form is a metal tube that is bent into a complex shape to form some element of the folding chair 10. The first tube form is the backrest tube form 12. The backrest tube form 12, being a bent single tube, has two free ends 14. The backrest tube form 12 is generally U-shaped having two parallel side sections 16 that are joined by a common crossbar section 18. A first fabric panel 20 is stretched between the two parallel side sections 16 to form the full backrest structure 22 of the folding chair 10.

The second tube form is the seat tube form 24. The seat tube form 24 creates the rear leg support 26 and the seat structure 28 of the folding chair 10. The seat tube form 24 is also made of a single tube and has two free ends 29. The seat tube form 24 is also generally U-shaped having two parallel side sections 30 that are joined by a common crossbar section 32. A second fabric panel 34 is stretched between the two parallel side sections 30 to complete the seat structure 28 of the folding chair 10. The two parallel side sections 30 are contoured to form the rear leg support 26, whereby the seat structure 28 is elevated to a position a few inches above the crossbar section 32.

The third tube form is the armrest tube form 40. The armrest tube form 40 creates the front leg support 42 and the armrests of the folding chair 10. The armrest tube form 40 is a single tube with two free ends 44. The armrest tube form is also generally U-shaped having two parallel side sections 46 that are joined by a common crossbar section 48. The two parallel side sections 46 are contoured to create armrests that are elevated above, and adjacent the seat structure 28.

Figure 2:
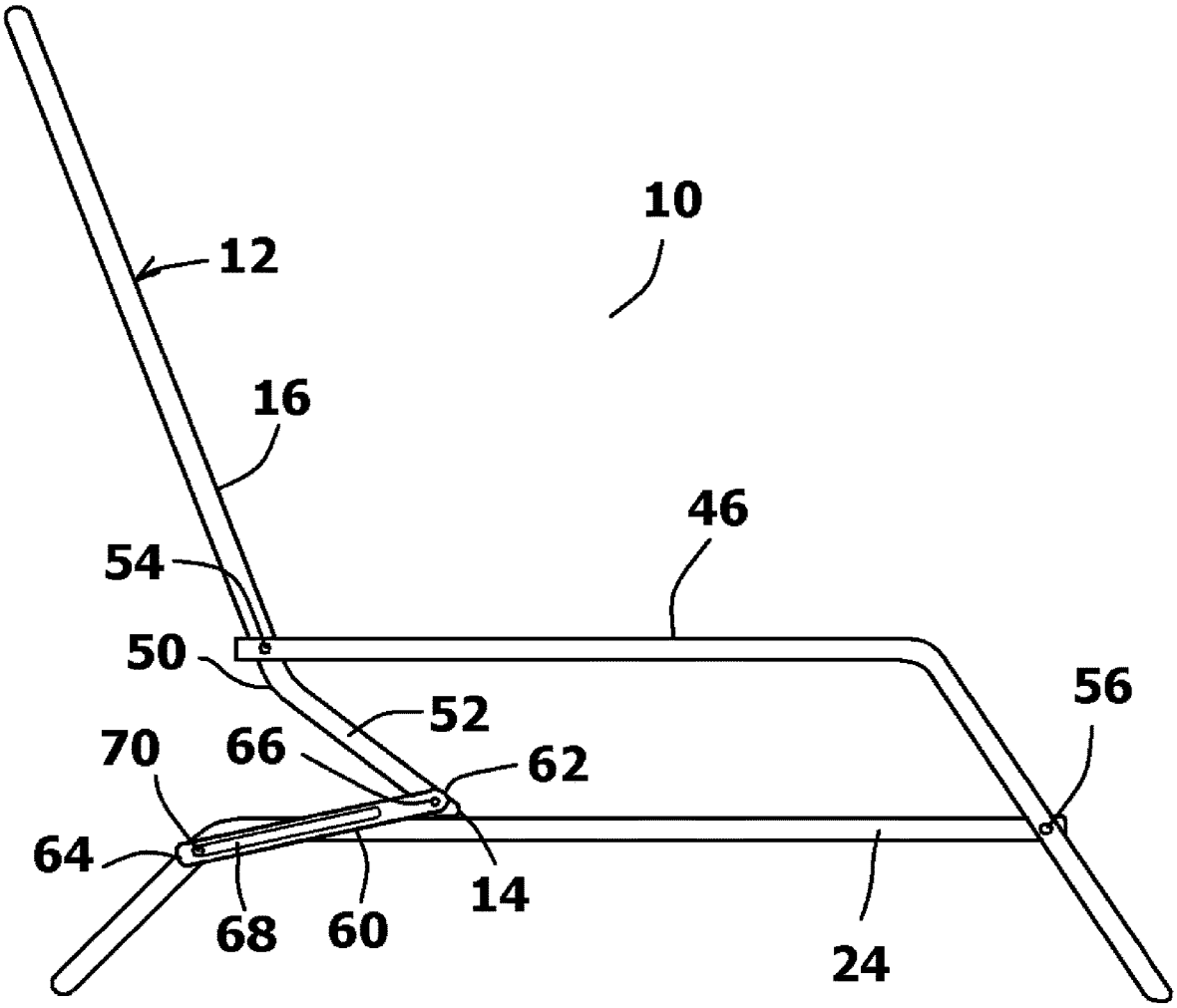
FIG. 2 is a right side view of the exemplary embodiment shown in a fully open configuration.

Referring to FIG. 2 in conjunction with FIG. 1, it can be seen that a bend 50 is formed in each of the parallel side sections 16 of the backrest tube form 12 proximate its free ends 14. This forms a dogleg 52 in each of the parallel side sections 16 that are necessary for the folding function of the folding chair 10.

The parallel side sections 16 of the backrest tube form 12 connect to the parallel side sections 46 of the armrest tube form 40 at pivot pin connections 54. The pivot pin connections 54 are positioned on the backrest tube form 12 just above the bend 50 of the dogleg 52. The pivot pin connections 54 are positioned on the armrest tube form 40 proximate its two free ends 44.

The armrest tube form 40 is directly connected to the seat tube form 24 with a second set of pivot pin connections 56. Accordingly, the armrest tube form 40 is directly connected to both the backrest tube form 12 and the seat tube form 24, therein interconnecting the backrest tube form 12 to the seat tube form 24.

The backrest tube form 12 is also connected to the seat tube form 24 via a set of slotted linkages 60. Each slotted linkage 60 is a bar of metal or plastic that has a first end 62 and a second end 64. The first end 62 is connected, via a pivot pin connection 66, to the backrest tube form 12 proximate the free ends 14 of the backrest tube form 12. A long slot 68 is formed in each slotted linkage 60. Each slot 68 extends between sixty percent and eighty percent of the length of the slotted linkage 60. Each slotted linkage 60 engages a fixed pin 70 that extends from the seat tube form 24.

In FIG. 2, the folding chair 10 is shown in its open configuration. When in its open configuration, the side sections 16 of the backrest tube form 12 are set at an obtuse angle relative the side sections 30 of the seat tube form 24. The free ends 14 of the backrest tube form 12 rest upon the side sections 30 of the seat tube form 24. The backrest tube form 12 is prevented from moving any farther away from the seat structure 28 by the armrest tube form 40. The backrest tube form 12 is prevented from rotating about the pivot pin connection 54 with the armrest tube form 40 by the physical limitations of the slotted linkages 60. The long slot 68 in each slotted linkage 60 and the length of the slotted linkage 60 are both engineered so that the fixed pin 70 on the seat tube form 24 reaches the end of the long slot 68 just as the backrest tube form 12 reaches its fully open position. The result is a highly stable configuration. When a person sits in the folding chair 10 and leans back on the backrest structure 22, both the side sections 46 of the armrest tube form 40 and the slotted linkages 60 are in tension. The tension in the side sections 46 of the armrest tube form 40 extend the front leg support 42 of the folding chair 10 to its maximum. Likewise, the tension in the slotted linkages 60 positions the fixed pin 70 to the distal end of the long slot 68. The slotted linkages 60 are in direct tension and can bear large forces in this configuration without any fear of bend damage.

Figure 3:
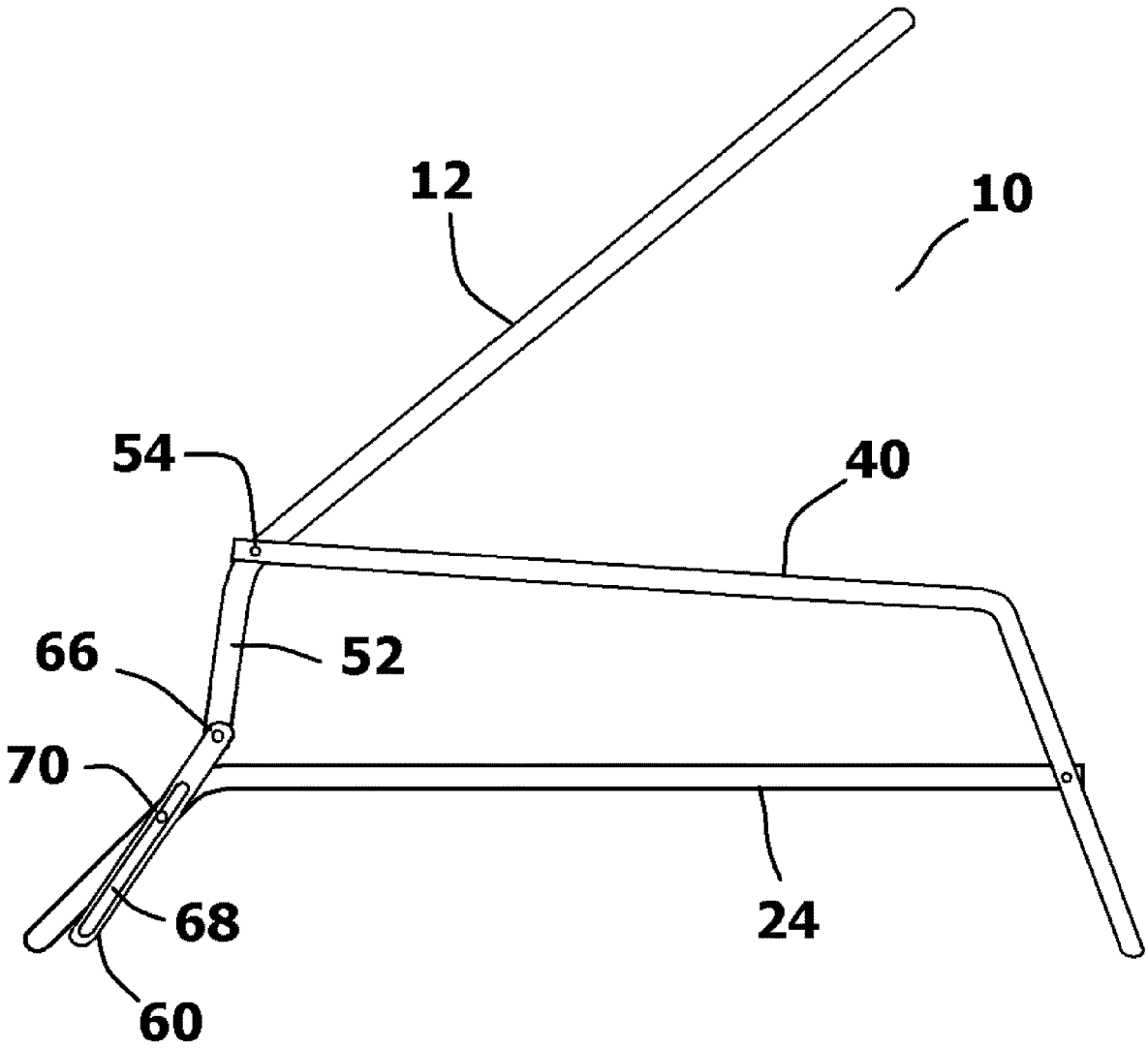
FIG. 3 is a right side view of the exemplary embodiment shown in a partially closed configuration.

Referring to FIG. 3 in conjunction with FIG. 1, it can be seen that as the folding chair 10 is manually folded, the backrest tube form 12 rotates about the pivot pin connections 54 with the armrest tube form 40. This lifts the doglegs 52 of the backrest tube form 12 out of contact with the seat tube form 24. The movement of each dogleg 52 causes the fixed pin 70 to move up the long slot 68 in the slotted linkages 60. As the rotation of the backrest tube form 12 continues, the pivot pin connection 66 at the first end 62 of the slotted linkage 60 reaches its closest point to the fixed pin 70 on the seat tube form 24. As the folding chair 10 continues to close, the distance between the fixed pin 70 and the pivot pin connector 66 again begins to increase.

Figure 4:
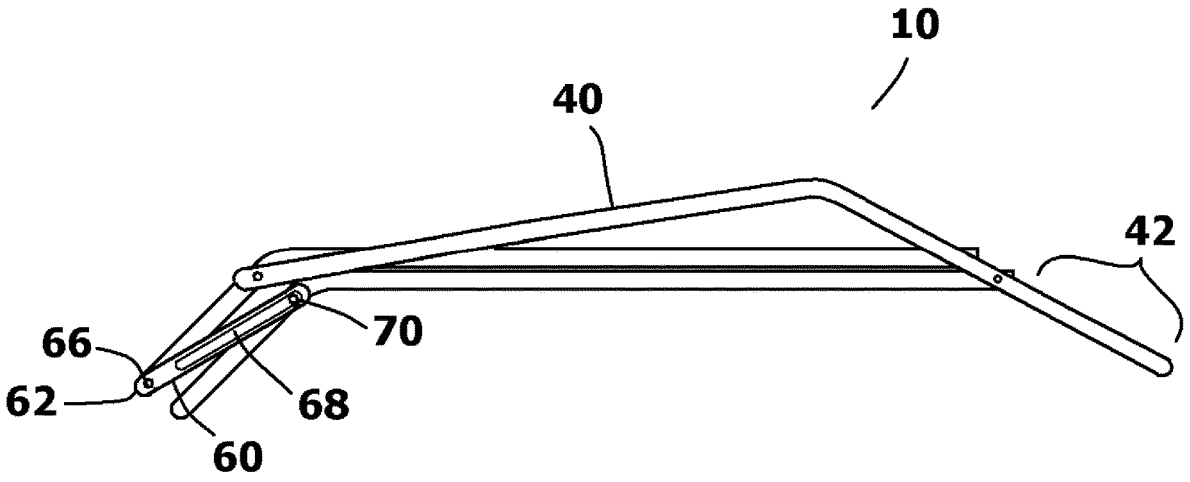
FIG. 4 is a right side view of the exemplary embodiment shown in a fully closed configuration.

Referring to FIG. 4 in conjunction with FIG. 1, it can be seen that as the folding chair 10 completely closes, the backrest fabric panel 20 lay flush against the seat fabric panel 34. The pivot pin connection 66 at the first end 62 of the slotted linkage 60 rotates away from the fixed pin 70. As such, the fixed pin 70 travels in the long slot 68 back toward the second end 64 of the slotted linkage 60. Simultaneously, the armrest tube form 40 is rotated to minimize the extension of the front leg support 42. The result is a folded chair 10 that is highly space efficient.

Figure 5:
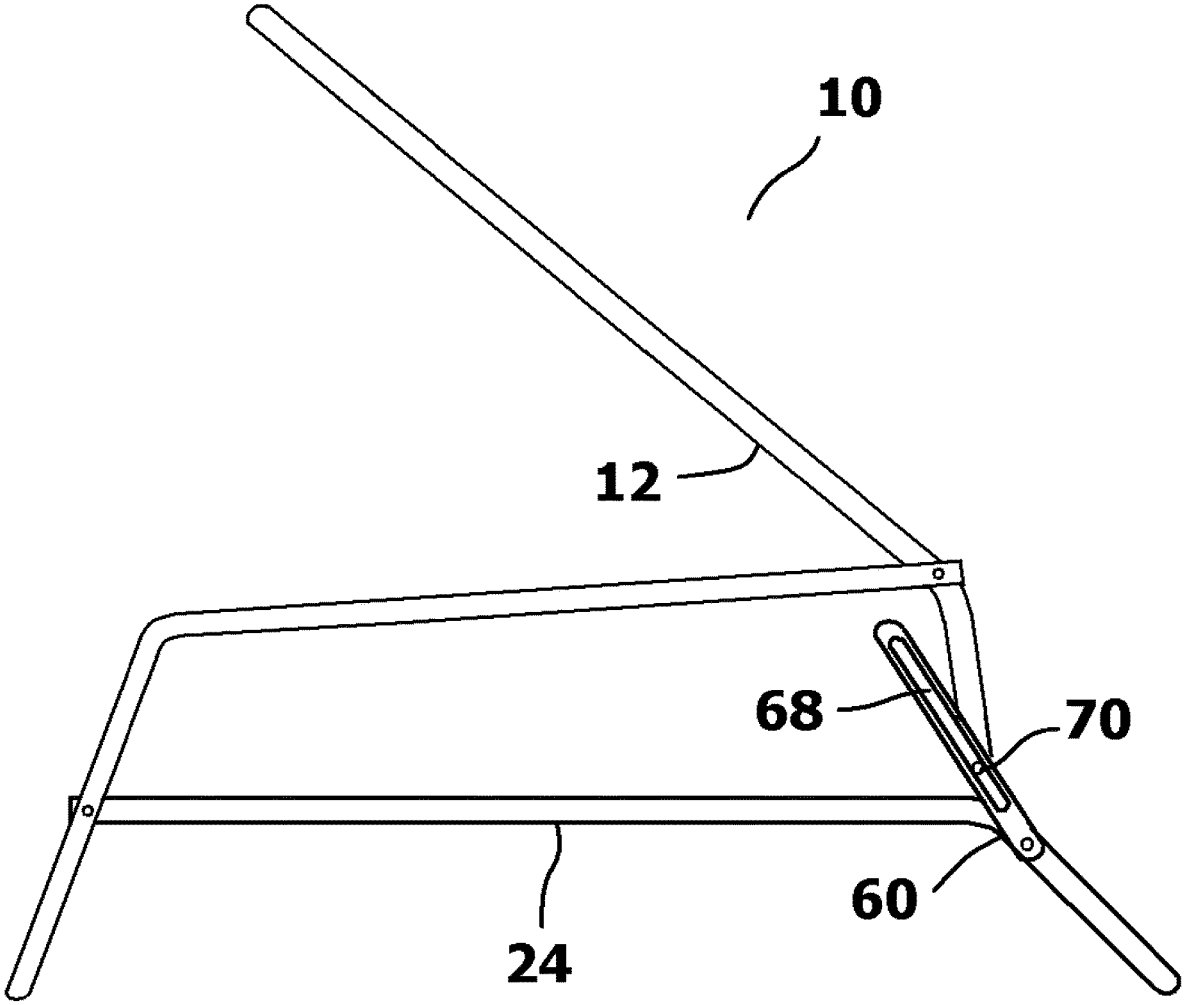
FIG. 5 is a left side view of the exemplary embodiment shown in a partially closed configuration with a reversed hinge assembly.

In FIG. 2, FIG. 3 and FIG. 4, the slotted linkage 60 forms part of the folding mechanism for the folding char. The slotted linkage 60 is anchored to the backrest tube form 12 and has a long slot 68 that engages a fixed pin 70 on the seat tube form 24. It will be understood that this configuration can be reversed, wherein the slotted linkage 60 is anchored to the seat tube form 24 and has a long slot 68 that engages a fixed pin 70 on the backrest tube form 12. This reversed configuration is shown in FIG. 5. FIG. 5 shows the left side of the folding chair 10. As such, for the purposes of explanation and description, FIG. 2, FIG. 3 and FIG. 4 show a first folding mechanism on the right side, while FIG. 5 shows a reversed folding mechanism on the left side.

It will be understood that the embodiment of the present invention that is illustrated and described is merely exemplary and that a person skilled in the art can make many variations to that embodiment. All such embodiments are intended to be included within the scope of the present invention as defined by the claims.

What is claimed is:

1. A folding chair assembly, comprising:

a backrest tube form having a first set of side sections connected by a crossbar section, wherein said first set of side sections terminate at a first set of free ends and wherein said first set of side sections contain first bends that form dogleg sections between said first bends and said first set of free ends;

a first fabric stretched between said two parallel side sections of said backrest tube form to form a backrest structure;

a seat tube form having a second set of side sections, wherein said second set of side sections terminate at a second set of free ends and wherein said second set of side sections contain second bends that form a rear leg support, wherein fixed pins extend from said rear leg support;

an armrest tube form having a third set of side sections, wherein said third set of side sections terminate at a third set of free ends, and wherein said third set of side sections contain third bends that form a front leg support;

a first set of pivot connections that connect said armrest tube form to said first set of side sections of said backrest tube form at points on said first set of side sections between said dogleg sections and said cross bar section;

a second set of pivot connections that connect said seat tube form to said front leg support of said seat tube form;

slotted linkages pivotably connected to said dogleg sections of said backrest structure, wherein said slotted linkages have lengths and slots that extend at least sixty percent of said lengths, and wherein said fixed pins from said seat structure extend into said slots and reciprocally move within said slots as said folding chair assembly is manipulated between a folded configuration and an open configuration.

2. The folding chair assembly according to claim 1, wherein said slotted linkages are pivotably affixed to said backrest tube form in said dogleg section proximate said first set of free ends.

3. The folding chair assembly according to claim 1, wherein said first set of free ends of said first tube form rests upon said seat tube form when said folding chair assembly is in said open configuration.

4. The folding chair assembly according to claim 1, wherein said backrest tube form, said seat tube form and said armrest tube form are all generally U-shaped.

5. The folding chair assembly according to claim 1, further including a second panel of fabric suspended within said seat tube form.

6. The folding chair assembly according to claim 5, wherein said first panel of fabric lay flush against said second panel of fabric when said folding chair assembly is in said folded configuration.

7. A folding chair assembly, comprising:

a backrest tube form having side sections with free ends, wherein said side sections have bends forming dogleg sections between said bends and said free ends;

a seat tube form having fixed pins extending therefrom;

an armrest tube form;

a first pivot connection that attaches said armrest tube form to said backrest tube form;

a second pivot connection that attaches said armrest tube form to said seat tube form;

slotted linkages pivotably connected to said seat tube form, wherein said slotted linkages have lengths and slots, and wherein said slots extend between sixty percent and eighty percent of said lengths, and wherein said fixed pins extend into said slots and reciprocally move within said slots as said folding chair assembly is manipulated between a folded configuration and an open configuration.

8. The folding chair assembly according to claim 7, wherein said armrest tube form is configured to provide a first leg support to said folding chair assembly.

9. The folding chair assembly according to claim 8, wherein said seat tube form is configured to provide a second leg support to said folding chair assembly.

* * * * *